US010327530B2

(12) United States Patent
Tarling et al.

(10) Patent No.: US 10,327,530 B2
(45) Date of Patent: Jun. 25, 2019

(54) SYSTEMS, DEVICES, AND METHODS INCLUDING A SWIRL SHAKE WEIGHT

(71) Applicant: L'Oreal, Paris (FR)

(72) Inventors: Christopher Tarling, Brooklyn, NY (US); Laurisa London, Clark, NJ (US)

(73) Assignee: L'Oreal, Paris (FR)

( * ) Notice: Subject to any disclaimer, the term of this patent is extended or adjusted under 35 U.S.C. 154(b) by 101 days.

(21) Appl. No.: 15/609,855

(22) Filed: May 31, 2017

(65) Prior Publication Data

US 2018/0344006 A1 Dec. 6, 2018

(51) Int. Cl.
*A45D 34/04* (2006.01)
*A45D 34/00* (2006.01)
(Continued)

(52) U.S. Cl.
CPC ..... *A45D 34/04* (2013.01); *A45D 34/00* (2013.01); *A45D 34/045* (2013.01); *A45D 34/046* (2013.01); *B01F 7/32* (2013.01); *B01F 11/0065* (2013.01); *B01F 11/0082* (2013.01); *B01F 13/0022* (2013.01); *B01F 13/0055* (2013.01); *B01F 13/0057* (2013.01); *B01F 15/00506* (2013.01); *B01F 15/00512* (2013.01); *A45D 2200/058* (2013.01)

(58) Field of Classification Search
CPC .... A45D 34/04; A45D 34/043; A45D 34/045; A45D 34/046; A45D 34/048; A45D 40/26; A45D 40/264; A45D 40/265; A45D 34/00; A45D 2200/058; A47J 43/27; A47J 43/042; B01F 13/0055; B01F 13/0057; B01F 7/32; B01F 11/0065; B01F 11/0082; B01F 13/0022; B01F 15/00506; B01F 15/00512
See application file for complete search history.

(56) References Cited

U.S. PATENT DOCUMENTS 2,983,946 A * 5/1961 Edelstone ..... A45D 34/045 366/130
3,136,532 A 6/1964 Rudnick
(Continued)

FOREIGN PATENT DOCUMENTS

DE 2 127 748 A1 12/1972
DE 10 2013 017 310 A1 1/2015
EP 0 013 721 A1 8/1980

OTHER PUBLICATIONS

Invitation to Pay Additional Fees and, Where Applicable, Protest Fee, and Partial Search Report dated Nov. 15, 2018, issued in corresponding International Application No. PCT/US2018/033957, filed May 22, 2018, 13 pages.

*Primary Examiner* — David J Walczak
(74) *Attorney, Agent, or Firm* — Christensen O'Connor Johnson Kindness PLLC

(57) ABSTRACT

A multi-phase cosmetic composition mixing pack for mixing immiscible components of a multi-phase cosmetic composition such that they are temporarily miscible includes a container for holding the multi-phase cosmetic composition that has a first open end and a container longitudinal axis, and a mixing element disposed within the container and configured to be actuated for mixing immiscible components of the multi-phase cosmetic composition such that they are temporarily miscible, wherein the mixing element is limited to movement substantially along the container longitudinal axis when actuated.

19 Claims, 17 Drawing Sheets

(51) Int. Cl.

| | |
|---|---|
| ***B01F 13/00*** | (2006.01) |
| ***B01F 7/32*** | (2006.01) |
| ***B01F 11/00*** | (2006.01) |
| ***B01F 15/00*** | (2006.01) |

(56) References Cited

U.S. PATENT DOCUMENTS

| | | | | |
|---|---|---|---|---|
| 6,379,032 | B1 | 4/2002 | Sorensen | |
| 9,295,316 | B2 * | 3/2016 | Mathiez | A45D 40/265 |
| 10,039,363 | B2 * | 8/2018 | Miller | A45D 34/048 |

* cited by examiner

SYSTEMS, DEVICES, AND METHODS INCLUDING A SWIRL SHAKE WEIGHT

SUMMARY

A multi-phase cosmetic composition mixing pack for mixing immiscible components of a multi-phase cosmetic composition such that they are temporarily miscible includes a container for holding the multi-phase cosmetic composition that has a first open end and a container longitudinal axis, and a mixing element disposed within the container and configured to be actuated for mixing immiscible components of the multi-phase cosmetic composition such that they are temporarily miscible, wherein the mixing element is limited to movement substantially along the container longitudinal axis when actuated.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
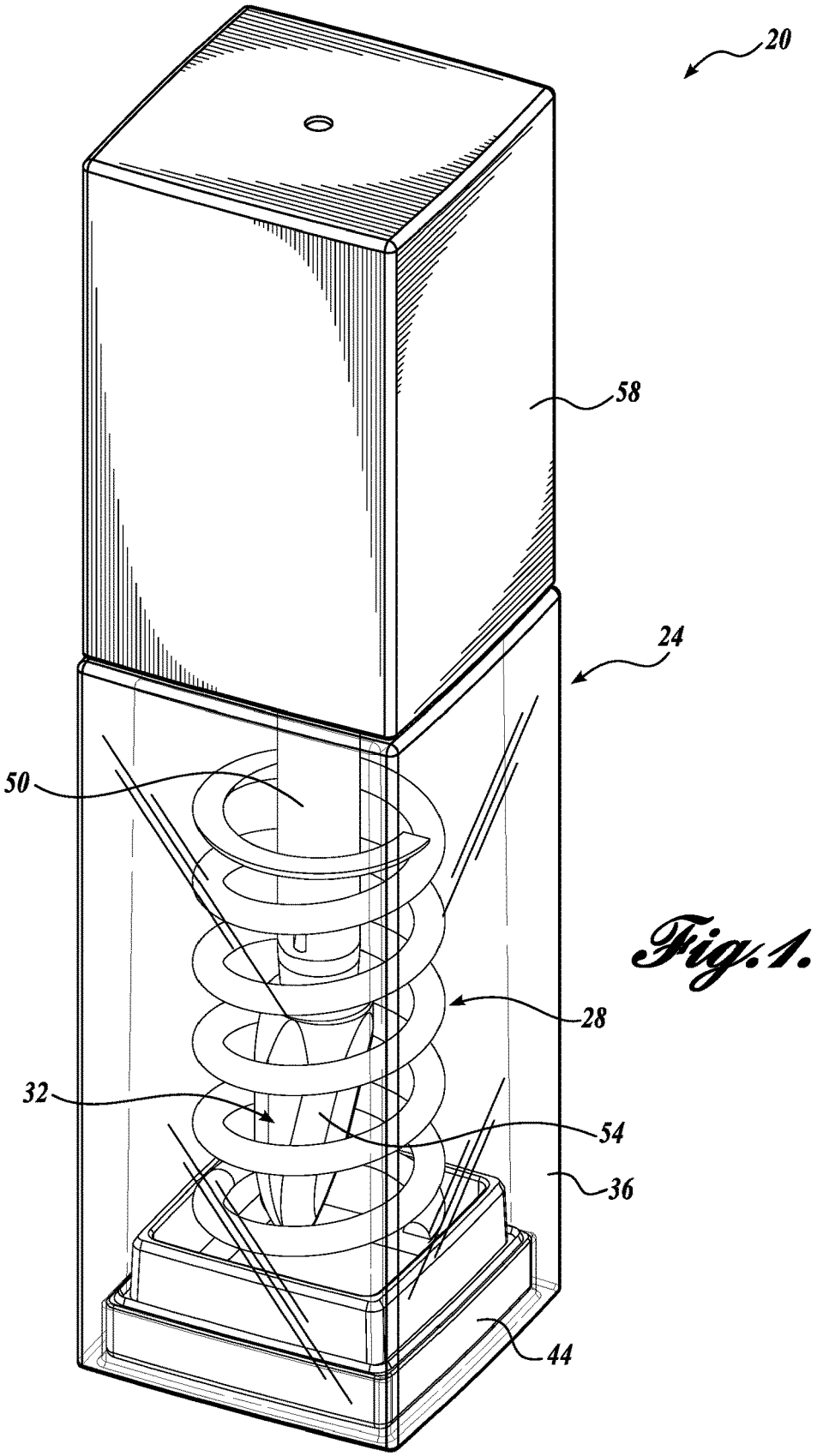
FIG. 1 is an isometric view of a mixing pack formed in accordance with a first exemplary embodiment of the present disclosure, wherein the mixing pack includes a mixing element.

Many cosmetic compositions, including pigmented cosmetics such as foundations and lipsticks, have been formulated in an attempt to possess longwearing properties upon application. Unfortunately, many of these compositions do not generally possess both good long-wear/transfer-resistance properties as well as good application properties, good comfort properties and/or good appearance properties (for example, shine, gloss or matte properties).

For example, with respect to lip products, commercial products containing silicon resins such as MQ resins are known. Such products are known to provide good long wear properties and/or transfer-resistance. However, such products possess poor application properties, poor feel upon application (for example, feel rough) and poor shine or gloss properties owing to the film formed by the MQ resin (for example, a matte appearance). Therefore, a second composition (topcoat) is separately applied to such products to improve poor properties of the compositions to make the products acceptable to consumers. Furthermore, the topcoat composition must be reapplied continually so that the product remains acceptable to consumers, meaning that the products are effectively not "long-wearing" as they require constant maintenance and reapplication.

Also, with respect to foundations, such products can provide good long wear properties and/or transfer-resistance. However, such long-wearing/transfer-resistant products can possess poor application and/or feel upon properties application, as well as poor matte properties.

"Single step" multi-phase cosmetic compositions having improved cosmetic properties, particularly good wear, feel, shine, gloss and/or matte characteristics upon application are described in U.S. patent application Ser. No. 15/144,716, entitled "Lip Compositions," filed on May 2, 2016, with the inventor Rita El-Khouri, U.S. patent application Ser. No. 15/144,622, entitled "Liquid Lipstick Compositions Capable of Forming a Multilayer Structure After Application to Lips," filed on May 2, 2016, with the inventor Rita El-Khouri, U.S. patent application Ser. No. 15/144,698 entitled "Lip Compositions Capable of Forming a Multilayer Structure After Application to Lips," filed on May 2, 2016, with the inventor Rita El-Khouri, U.S. Provisional Patent Application No. 62/316,309, entitled "Cosmetic Compositions Capable of Forming a Multilayer Structure After Application to a Keratinous Material," filed on Mar. 31, 2016, with the inventor Rita El-Khouri, and Patent Cooperation Treaty (PCT) Application No. PCT/US2017/025370, titled "Cosmetic Compositions Capable of Forming a Multilayer Structure After Application to Keratinous Material," filed on Mar. 31, 2017, with the inventor Rita El-Khouri, the disclosures of which are incorporated by reference herein in their entirety.

The above-referenced applications disclose, for example, a multi-phase cosmetic composition for keratinous materials (for example, skin, hair, eyelashes, nails or lips) which has good cosmetic properties such as, for example, good adhesion, transfer-resistance, feel, gloss (or shine), and/or matte upon application, and which can be applied to a keratinous material without having to engage in a multi-step application process. More specifically, the above-referenced applications disclose multi-phase cosmetic compositions that comprise at least two immiscible components prior to application and that are capable of forming a multilayer structure after application to a keratinous material. Such multi-phase cosmetic compositions allow for benefits associated with multi-layer cosmetic products without having to engage in a multi-step application process.

Immiscibility of the immiscible components can result from an incompatibility between the two components when the composition is at rest, an incompatibility between the two components after application to a keratinous material, or both. When the immiscible components result from an incompatibility between the two components when the composition is at rest, i.e., in a cosmetic container, the immiscible components must be appropriately mixed prior to application of the multi-phase cosmetic composition to the keratinous material. Once appropriately mixed, the multi-phase cosmetic composition comprising the temporarily miscible components can be applied to the keratinous material. Subsequent to application to the keratinous material, the components separate to form a multilayer structure on the keratinous material.

In an aspect, technologies and methodologies include a mixing pack that can be used for mixing a multi-phase cosmetic composition so that the immiscible components are temporarily miscible. For purposes of this detailed description, the term "mixing" (or like versions, such as "mixer", "mix", or "mixed") shall be interpreted to include any suitable mixing, blending, churning, emulsifying, etc., of a multi-phase cosmetic composition so that the immiscible components are temporarily miscible.

Figure 2:
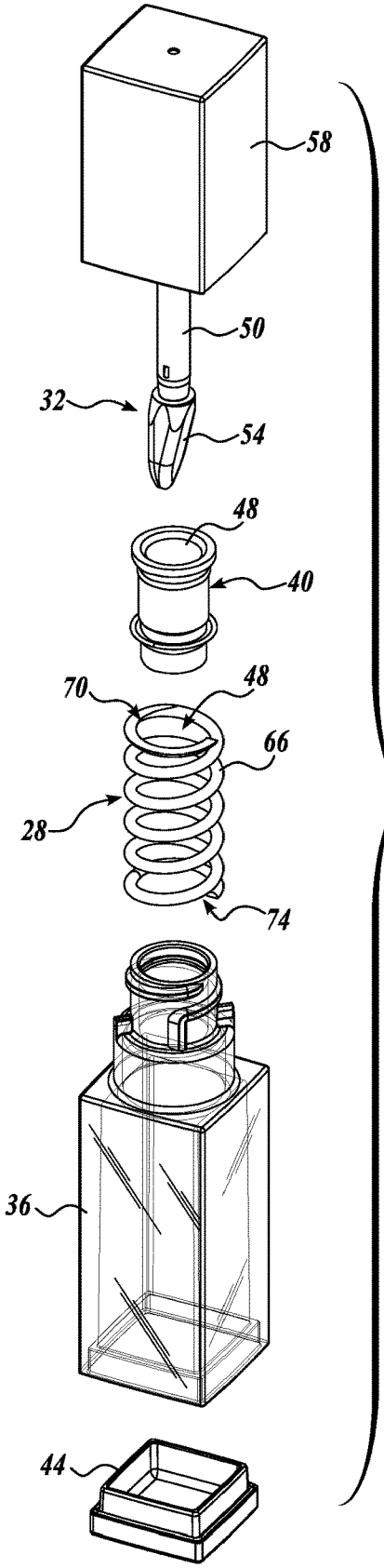
FIG. 2 is an exploded view of the mixing pack of FIG. 1.
Figure 3:
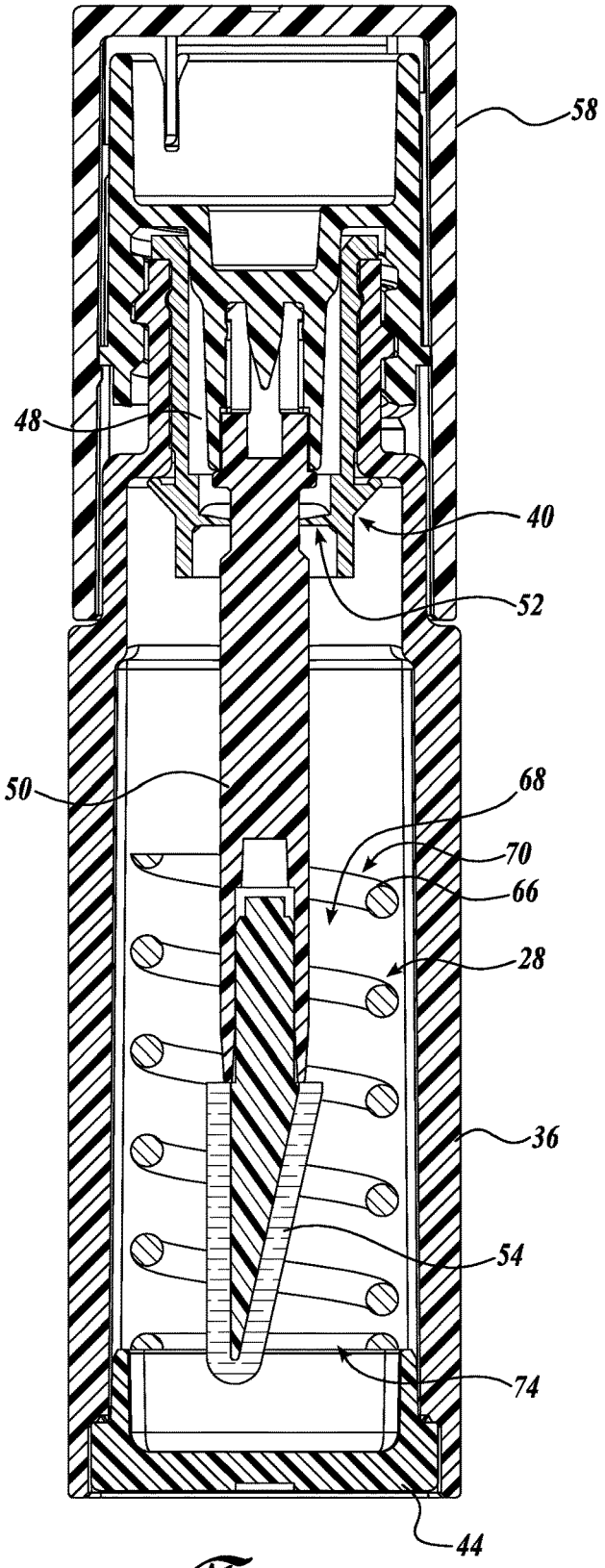
FIG. 3 is a cross-sectional view of the mixing pack of FIG. 1.

Turning now to FIGS. 1-3, there is shown a first exemplary embodiment of a mixing pack 20 suitable for mixing a multi-phase cosmetic composition (not shown) so that the immiscible components are temporarily miscible. The mixing pack 20 generally includes a container 24 for holding a multi-phase cosmetic composition, a mixing element 28 for mixing the multi-phase cosmetic composition, and an applicator 32 for applying the temporarily miscible components of the multi-phase cosmetic composition to a keratinous material.

Referring to FIGS. 1-3, the container 24 will first be described in detail. The container 24 may be any suitable shape, size, configuration, material, etc., to appropriately hold a desired multi-phase cosmetic composition. In the depicted embodiment, the container 24 includes a substantially rectangular-shaped glass or plastic container body 36, having first and second open ends that are enclosed by first and second end caps 40 and 44. The first and second (or top and bottom) container end caps 40 and 44 may be press-fit or otherwise secured to or within the open ends of the container body 36 in any suitable manner.

In the depicted embodiment, the second (or bottom) end cap 44 encloses and seals the second, bottom open end of the container body 36, and the first (or top) end cap 40 encloses and seals the first, top open end of the container body 36 and provides an interface between the applicator 32 and the interior of the container 24. In that regard, the first end cap 40 includes a central opening 48 extending from a top surface to a bottom surface of the first end cap 40. The central opening 48 is sized to allow the applicator 32 to pass therethrough, which in the depicted embodiment includes a stem 50 and applicator portion or tip 54 defined at the distal end thereof. The stem 50 may pass through the central opening 48 and extend into the container body 36 to position the tip 54 within the interior of the container body 36 for withdrawing the multi-phase cosmetic composition for application to a keratinous material. The first end cap 40 may include an internal wiping assembly 52 that helps wipe excess cosmetic composition from the applicator tip 54 as it is removed from the container body 36. Any suitable internal wiping assembly for the intended application may be used.

The stem 50 of the applicator 32 extends from an interior portion of a cap 58 that is removably securable to the first, top open end of the container body 36 for sealing and enclosing the cosmetic composition therein. The cap 58 may be removably secured to the top end of the container body 36 in any suitable manner, such as by threading, a snap-fit, friction fit, or otherwise.

It should be appreciated that the container 24 may instead be comprised of a container body that is integrally formed with first and second end caps 40 and 44. Moreover, the container body 36 and the first and second end caps 40 and 44 may be formed from any suitable material in any suitable manner. For instance, the container body 36 and first and second end caps 40 and 44 may be integrally or separately formed by injection molding. Furthermore, any other suitable container body 36, cap 58 and applicator 32 may be used for the desired application. For instance, the container may be configured to suit the intended use, for example, lip gloss, foundation, concealer, lacquer, etc.

An exemplary mixing element 28 suitable for mixing the multi-phase cosmetic composition contained within the container 24 will now be described. In the embodiment depicted in FIGS. 1-3, the mixing element 28 is embodied as a swirl shake weight or coil spring 66 made from a suitable metal or other material. The coil spring 66 includes a central opening 68 extending between a first open end 70 and a second open end 74. As such, the stem 50 and tip 54 of the applicator 32 may extend through the first open end 70 and into the central opening 68 of the coil spring 66; i.e., the coil spring 66 may be positioned within the container 24 such that it at least partially surrounds the applicator 32. With the coil spring 66 being open at the first and second ends 70 and 74, the spring 66 may move axially along the length of the applicator 32 and container 24.

The container 24 is suitably sized and shaped to enclose the coil spring 66 (or the coil spring 66 is sized to fit within the container 24) such that when the coil spring 66 is actuated (i.e., shaken), the multi-phase cosmetic composition contained within the container 24 is appropriately mixed. In that regard, the coil spring 66 has a length that generally extends along a portion of the length of the container body 36, such as three-quarters (¾) of the container body length. In that manner, the coil spring 66 may move longitudinally or axially back and forth along the length of the container body 36. The spring helix or coil also has a nominal diameter that is sufficiently large such that coil spring 66 is substantially limited to movement in the longitudinal or axial direction of the container. In other words, the coil spring 66 cannot substantially move laterally, flip over, etc. For example, the spring helix may have a nominal diameter that is substantially the same size as an interior diameter of the container body 36. As such, the coil spring 66 reaches substantially all the contents of the container 24 when shaken to ensure substantially even mixing of the immiscible components.

More specifically, the immiscible components flow into and out of the first and second open ends 70 and 74 of the coil spring 66 as well as into and out of the openings defined by the spring helix. In that regard, any suitable helical geometry (pitch, cross-sectional shape, etc.) may be used for the intended application. For instance, a low viscosity multi-phase cosmetic composition may be sufficiently mixed with a lower pitch helix design, wherein a higher viscosity multi-phase cosmetic composition may require a higher pitch helix design to sufficiently mix the immiscible components.

The coil spring 66 may be a heavy-duty helical spring designed for compression and tension. In that manner, the coil spring 66 compresses and extends minimally if not at all as it is shaken within the container 24. In an alternative embodiment, the coil spring 66 may be embodied as a compression spring having sufficient elasticity such that it extends and compresses more significantly when shaken. In the depicted embodiment, the coil spring 66 also has a substantially circular cross-sectional shape and flattened first and second ends that connect back or join the adjacent coil. However, any suitable cross-sectional shape and end configuration may instead be used. It can be appreciated that the coil spring configuration will be dependent on the intended application of the mixing pack 20. Accordingly, the descriptions and illustrations provided herein should not be seen as limiting.

FIGS. 4-8 depict alternative exemplary embodiments of a mixing element 128, 228, 328, 428, and 528 suitable for mixing a multi-phase cosmetic composition contained within the container 24 or any other suitable container. Each mixing element 128, 228, 328, 428, and 528 is made from a suitable material, such as metal, and is of a suitable length and nominal diameter for mixing a multi-phase cosmetic composition in a desired container. Moreover, the characteristics of each mixing element 128, 228, 328, 428, and 528 are clearly shown in FIGS. 4, 5, 6, 7, and 8, respectively, accordingly, the characteristics of each mixing element will be only briefly described.

Figure 4:
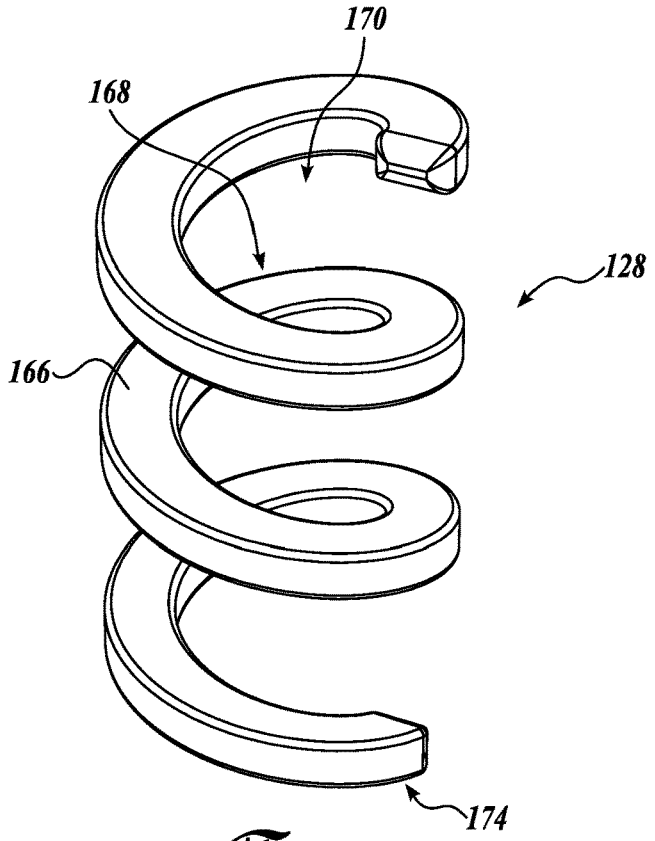
FIG. 4 is an isometric view of a mixing element formed in accordance with a first alternative exemplary embodiment of the present disclosure that is suitable for use with the mixing pack of FIG. 1.

Referring to FIG. 4, the mixing element 128 is configured as a swirl shake weight or a coil spring 166 having a central opening 168 extending between first and second open ends 170 and 174, similar to coil spring 66, except that the coil has a substantially rectangular cross-sectional shape and it terminates in rounded or semi-pointed ends. The coil spring 166 may have little to no elasticity such that only minimal to no compression or extension results from shaking the coil spring 166, or a predetermined amount of elasticity.

Figure 5:
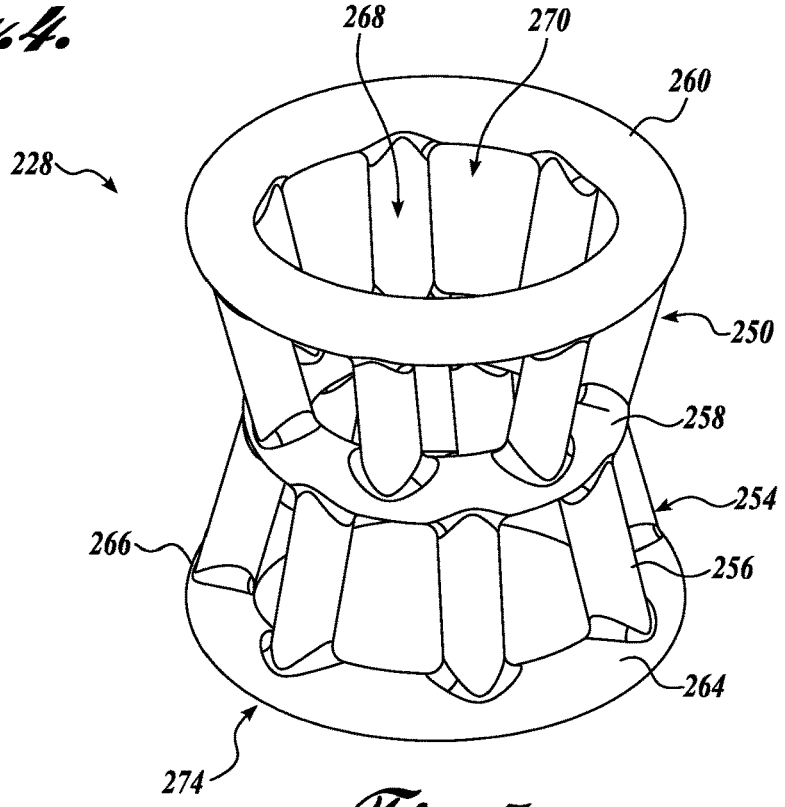
FIG. 5 is an isometric view of a mixing element formed in accordance with a second alternative exemplary embodiment of the present disclosure that is suitable for use with the mixing pack of FIG. 1.

Referring to FIG. 5, the mixing element 228 is configured as a double cage shake weight 266 having a central opening 268 extending between a first open end 270 and a second open end 274. The double cage shake weight 266 includes a first cage 250 stacked on a substantially identical and mirrored second cage 254. Each cage 250 and 254 includes bars 256 extending substantially axially and slightly outwardly from a middle annular base 258 to a first or second end annular base 260 and 264, respectively. The bars 256 are spaced substantially evenly around the circumference of the middle annular base 258 and the end annular bases 260 and 264. The bars 256 and annular bases 258, 260, and 264 are substantially circular in cross-sectional shape; however, any suitable shape may instead be used.

Figure 6:
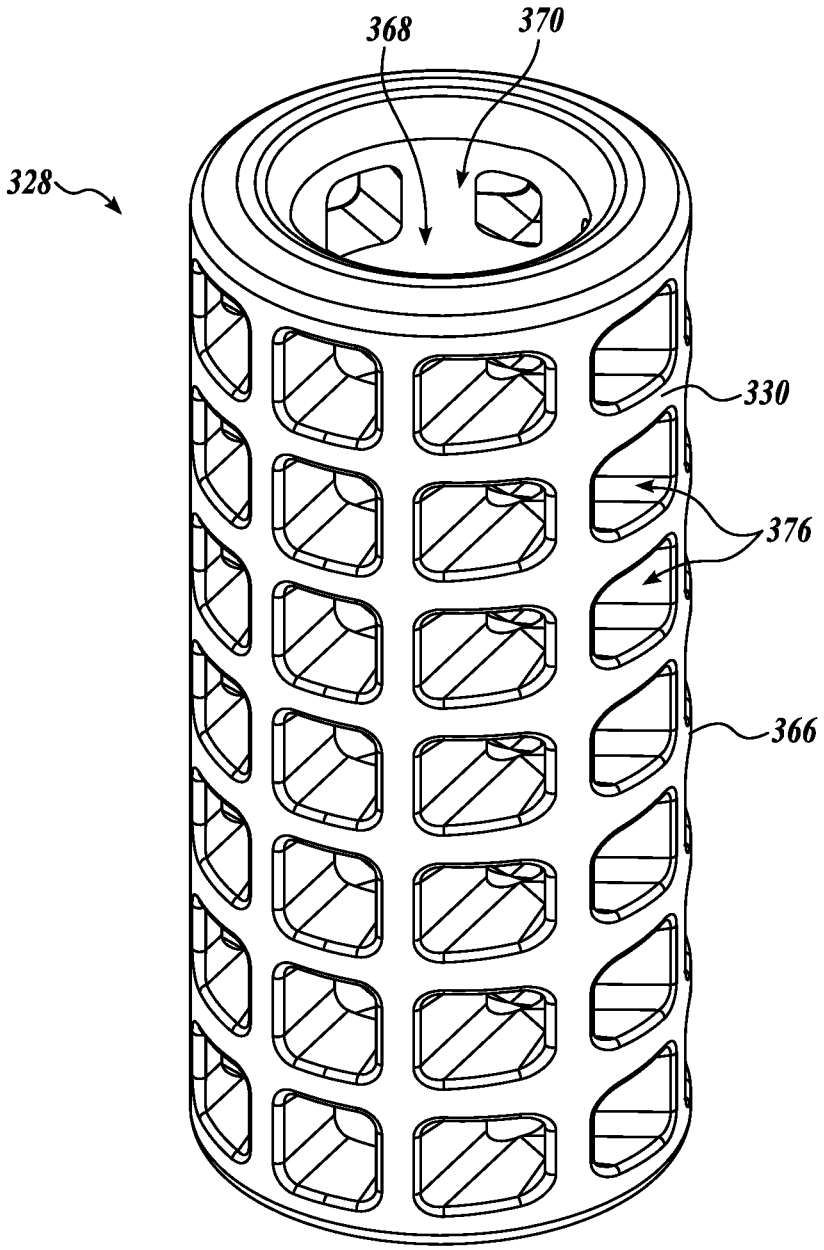
FIG. 6 is an isometric view of a mixing element formed in accordance with a third alternative exemplary embodiment of the present disclosure that is suitable for use with the mixing pack of FIG. 1.

Referring to FIG. 6, the mixing element 328 is configured as a shake weight 366 having a cylindrical body 330 with a central opening 368 extending between a first open end 370 and a second open end (not shown). The cylindrical body 330 includes a plurality of patterned openings 376 extending from an exterior surface to an interior surface of the body 330, wherein the cylindrical body 330 has a thickness extending between the exterior surface and the interior surface. In the depicted embodiment, the patterned openings 376 are substantially rectangular or square in shape and may taper in size as the opening extends from the exterior surface to the interior surface of the body 330. The openings 376 extend generally radially toward a central axis of the cylindrical body 330, although certain openings 376 may extend diametrically across the body 330.

Figure 7:
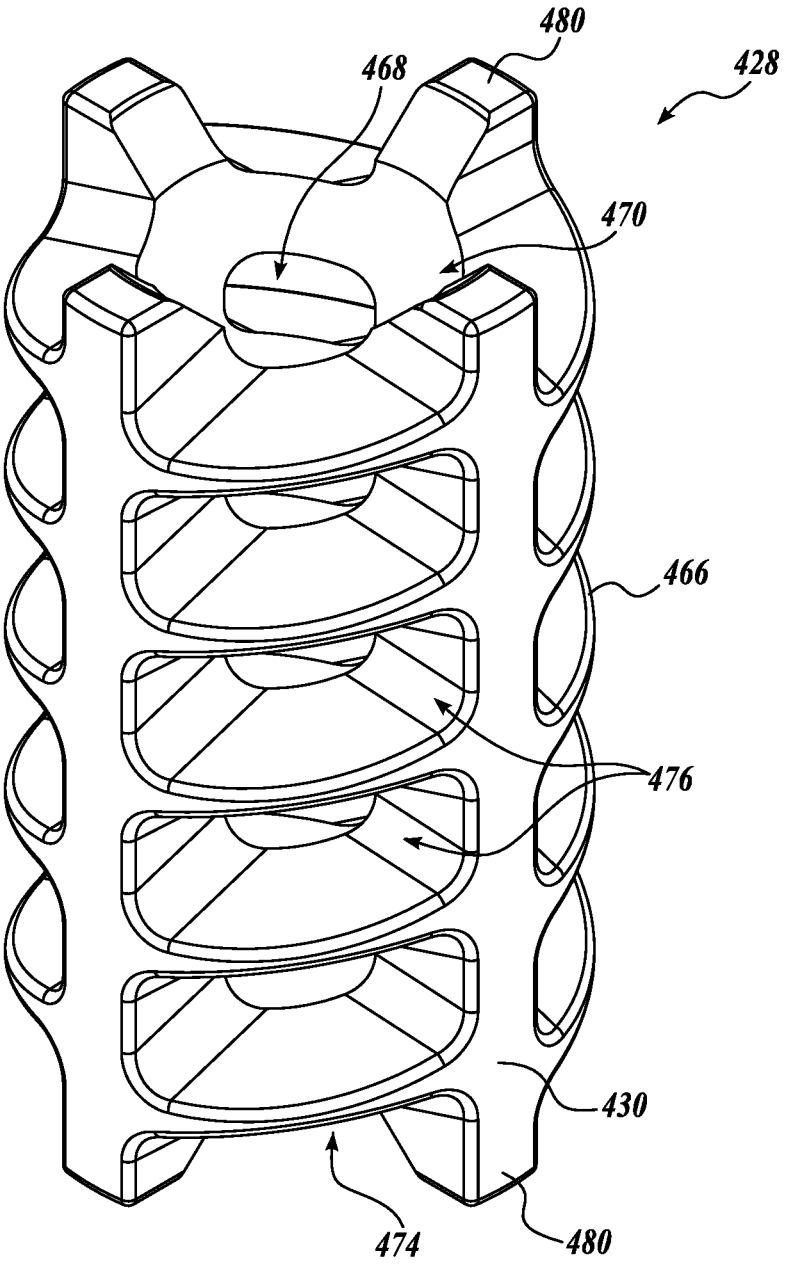
FIG. 7 is an isometric view of a mixing element formed in accordance with a fourth alternative exemplary embodiment of the present disclosure that is suitable for use with the mixing pack of FIG. 1.

Referring to FIG. 7, the mixing element 428 is configured as a shake weight 466 having a cylindrical body 430 with a central opening 468 extending between a first open end 470 and a second open end 474, wherein a plurality of legs 480 extend axially from the first and second open ends 470 and 474. The cylindrical body 430 includes a plurality of helically patterned openings 476 extending from an exterior surface to an interior surface of the body 430, wherein the cylindrical body 430 has a thickness extending between the exterior surface and the interior surface. In the depicted embodiment, the patterned openings 476 are substantially rectangular in shape and taper in size as the opening extends radially from the exterior surface to the interior surface of the body 430.

Figure 8:
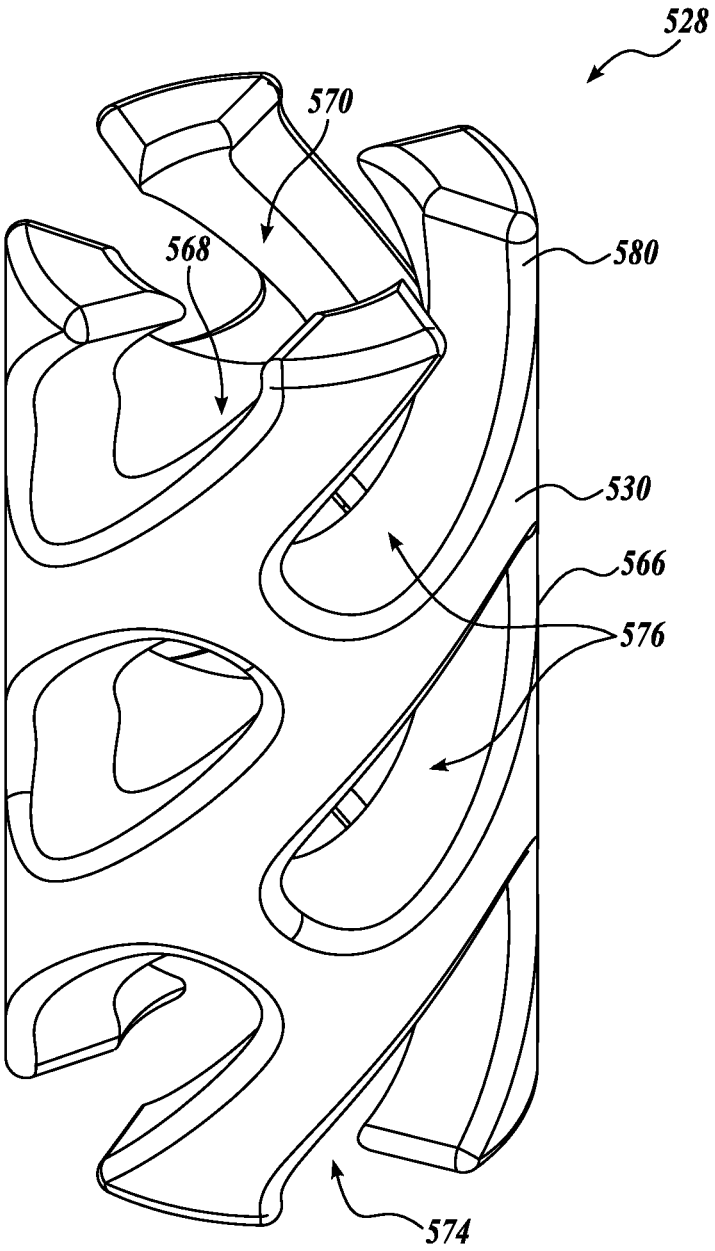
FIG. 8 is an isometric view of a mixing element formed in accordance with a fifth alternative exemplary embodiment of the present disclosure that is suitable for use with the mixing pack of FIG. 1.

Referring to FIG. 8, the mixing element 528 is configured as a shake weight 566 having a cylindrical body 530 with a central opening 568 extending between a first open end 570 and a second open end 574, wherein a plurality of legs 580 extend helically from the first and second open ends 570 and 574. The cylindrical body 530 includes a plurality of helically patterned openings 576 extending from an exterior surface to an interior surface of the body 530, wherein the cylindrical body 530 has a thickness extending between the exterior surface and the interior surface. In the depicted embodiment, the patterned openings 576 are substantially egg-shaped and may taper in size as the opening extends radially from the exterior surface to the interior surface of the body 530. Moreover, the openings 576 may differ in size as the pattern extends helically around the body 530.

The mixing elements 28, 128, 228, 328, 428, and 528 may have a weight that corresponds to a certain thickness or viscosity of multi-phase cosmetic composition.

Figure 9:
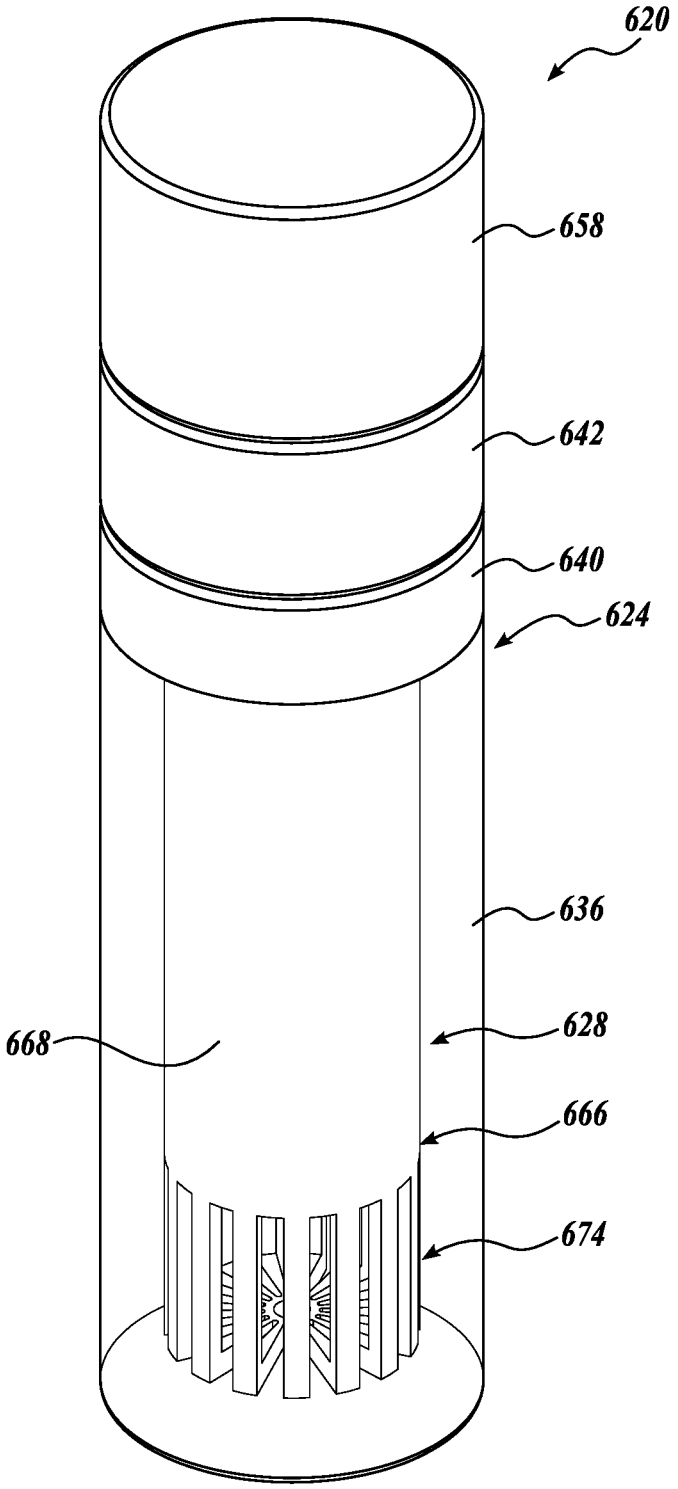
FIG. 9 is an isometric view of a mixing pack formed in accordance with a second exemplary embodiment of the present disclosure, wherein the mixing pack includes a mixing element.
Figure 10:
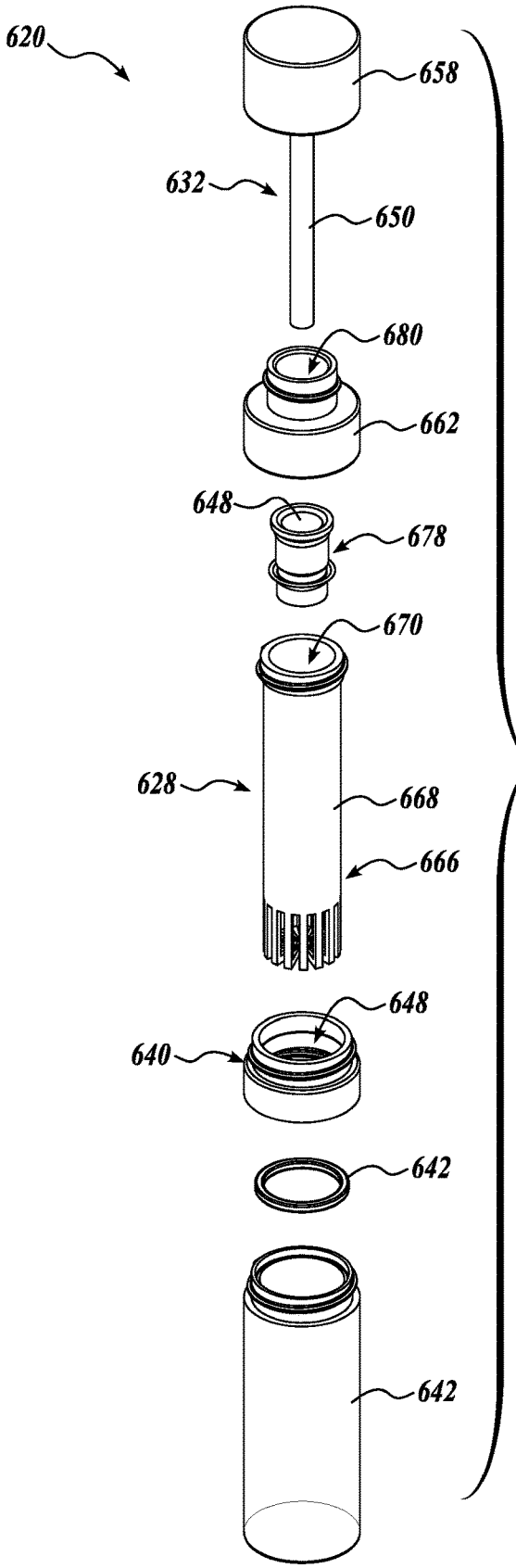
FIG. 10 is an exploded view of the mixing pack of FIG. 9.
Figure 11:
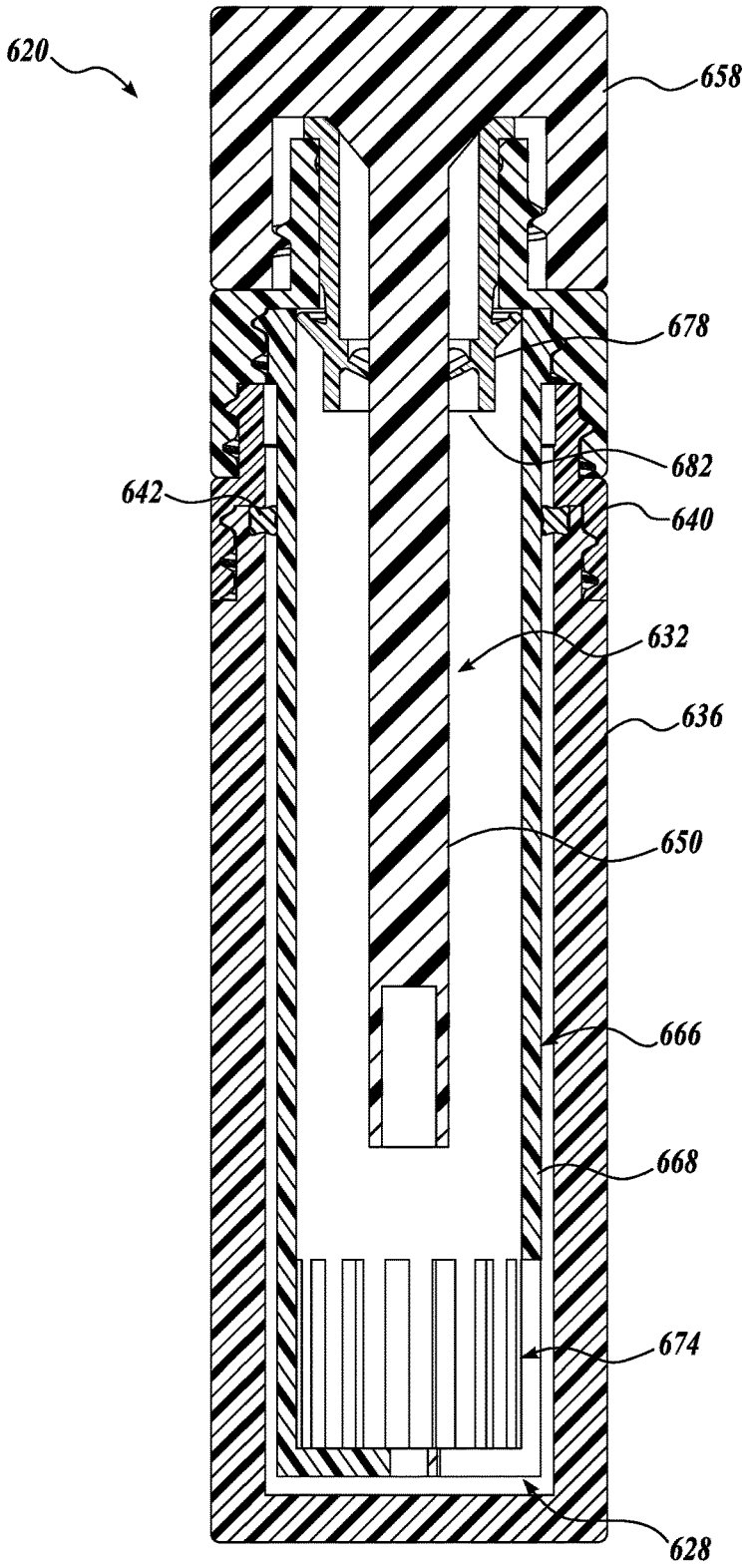
FIG. 11 is a cross-sectional view of the mixing pack of FIG. 9.

FIGS. 9-11 depict a second exemplary embodiment of a mixing pack 620 suitable for mixing a multi-phase cosmetic composition (not shown) so that the immiscible components are temporarily miscible. The mixing pack 620 generally includes a container 624 for holding a multi-phase cosmetic composition, a mixing element 628 for mixing the multi-phase cosmetic composition, an actuation assembly for actuating the mixing element 628, and an applicator 632 for applying the temporarily miscible components of the multi-phase cosmetic composition to a keratinous material.

The container 624 will first be described in detail. The container 624 may be any suitable shape, size, configuration, material, etc., to appropriately hold a desired multi-phase cosmetic composition. In the depicted embodiment, the container 624 includes a substantially cylindrically-shaped glass or plastic container body 636 having a first (or top) open end that receives a first container end cap 640 secured to the body 636 by threading, snap-fit, or otherwise. A sealing element, such as an O-ring 642, may be disposed between the container end cap 640 and the body 636. It should be appreciated that the container 624 may instead be comprised of a container body that is integrally formed with the first container end cap 640.

The first container end cap 640 encloses and seals the first, top open end of the container body 636 and provides an interface between the mixing element 628 and the interior of the container 624. In that regard, the first container end cap 640 includes a central opening 648 extending from a top surface to a bottom surface of the first container end cap 640 that is sized to allow the mixing element 628 to pass therethrough.

An exemplary mixing element 628 suitable for mixing the multi-phase cosmetic composition contained within the container 624 will now be described. In the embodiment depicted in FIGS. 9-11, the mixing element 628 is embodied as a perforated plunger 666 having a plunger body 668 that is cylindrical in shape (to substantially match the shape of the container body 636) and made from a suitable material, such as plastic or metal, with a central opening 670 extending between a first open end and a second perforated end (not labeled). The second or bottom perforated end of the plunger body 668 includes a plurality of perforations 674 in fluid communication with the central opening 670 that are configured to cause mixing of the immiscible components of the multi-phase cosmetic composition as the plunger 666 is actuated; e.g., as it is moved substantially axially within the container body 636. More specifically, the immiscible components flow into and out of the central opening 670 through the plurality of perforations 674 as the plunger 666 is actuated.

The second perforated end may include any suitable number and configuration of openings or perforations 674, such as size, shape, length, etc., for the intended application. For instance, a low viscosity multi-phase cosmetic composition may be sufficiently mixed with a smaller number of larger openings, wherein a higher viscosity multi-phase cosmetic composition may require a larger number of smaller openings to sufficiently mix the immiscible components. In the depicted embodiment, each perforation 674 extends axially along a length of a bottom portion of the plunger body 668 and continues radially onto a bottom surface of the plunger body 668 to connect to the other perforations 674 at substantially the center of the bottom surface. Any other suitable pattern and configuration of perforations 674 may instead be used.

The container 624 is suitably sized and shaped to enclose the perforated plunger 666 (or the perforated plunger 666 is sized to fit within the container 624) such that when the perforated plunger 666 is actuated (i.e., moved axially within the container body 636), the multi-phase cosmetic composition contained within the container 624 is appropriately mixed. In that regard, the perforated plunger 666 has a length that generally extends along the length of the container body 636 and a nominal diameter that is sufficiently large such that the plurality of perforations 674 reaches substantially all the contents at the bottom of the container 624 when actuated.

As noted above, the perforated plunger 666 includes a plunger body 668 having a central opening 670 extending from the first open end. A plunger cap 678 is sealingly securable within the first open end of the plunger body 668, and it includes a central opening 680 configured to removably receive the stem 650 and any tip (not shown) of the applicator 632. The stem 650 may pass through the central opening 680 of the plunger cap 678 and extend into the container body 636 to position the distal end of the stem 650 within the interior of the container body 636 for withdrawing the multi-phase cosmetic composition for application to a keratinous material. The plunger cap 678 may include an internal wiping assembly 682 that helps wipe excess cosmetic composition from any applicator tip as it is removed from the container body 636. Any suitable internal wiping assembly for the intended application may be used.

The first or upper end of the perforated plunger 666 is secured within an interior of a mixing element cap 662 that is removably secured to the first container end cap 640 of the container body 636 in a suitable manner, such as by threading, snap-fit, press fit, or otherwise, and the mixing element cap 662. In that manner, the perforated plunger 666 is removable from the interior of the container 624 when the mixing element cap 662 is detached from the container body 636.

The mixing element cap 662 includes a central opening 680 extending from a top surface to a bottom surface of the cap 662 that is configured to allow the stem 650 of the applicator 632 to pass therethrough. The stem 650 of the applicator 632 extends from an interior portion of a applicator cap 658 that is removably securable to the mixing element cap 662 (which is removably secured to the first container end cap 640 of the container body 636) for sealing and enclosing the cosmetic composition therein. The applicator cap 658 is removably secured to the mixing element cap 662 by threading, snap-fit, press-fit, or otherwise.

To use the mixing pack 620, the mixing element cap 662 is detached from the first container end cap 640 of the container body 636 and the perforated plunger 666 is actuated; i.e., moved axially within the container body 636. The perforated plunger 666 is actuated until the multi-phase cosmetic composition contained within the container 624 is appropriately mixed so that the immiscible components are temporarily miscible. Once the composition is mixed, the mixing element cap 662 may be re-attached to the first container end cap 640 of the container body 636, and the applicator cap 658 may be detached from the mixing element cap 662. With the applicator cap 658 detached, the applicator 632 can be withdrawn from the container 624 for application of the temporarily miscible components of the multi-phase cosmetic composition to a keratinous material.

It should be appreciated that any other suitable container body, caps, and applicator may be used for the desired application. For instance, the container may be configured to suit the intended use, for example, lip gloss, foundation, concealer, lacquer, etc.

Figure 12:
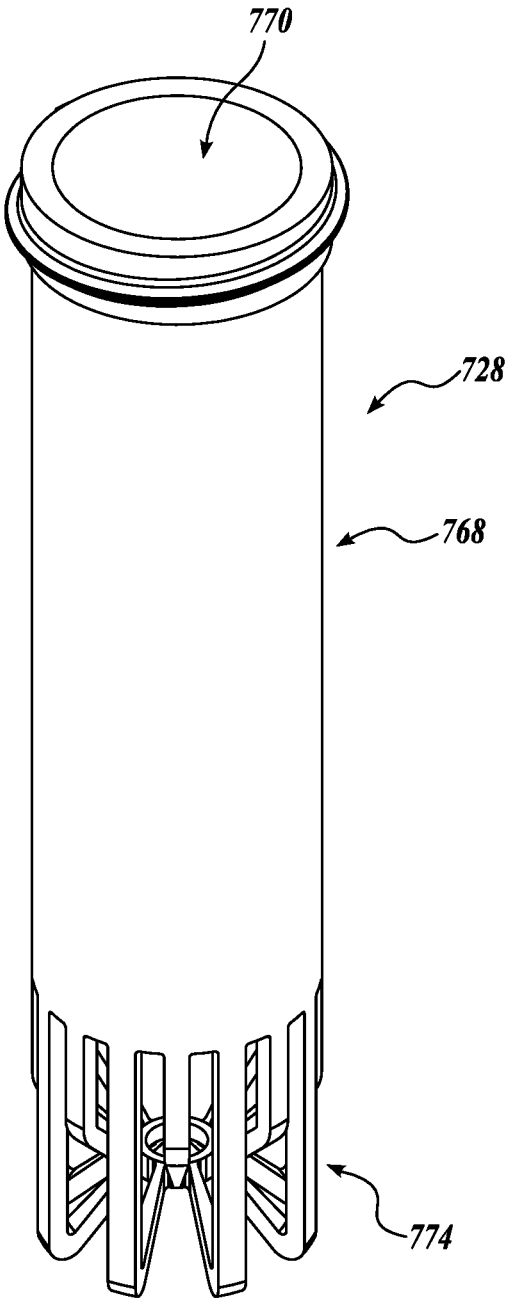
FIG. 12 is an isometric view of a mixing element formed in accordance with a first alternative exemplary embodiment of the present disclosure that is suitable for use with the mixing pack of FIG. 9.

FIG. 12 depicts an alternative exemplary embodiment of a mixing element 728 suitable for mixing a multi-phase cosmetic composition contained within the container 624 or any other suitable container. The mixing element 728 is substantially identical to the mixing element 628 described above in that it is configured as a perforated plunger 766 having a plunger body 768 that is cylindrical in shape (to substantially match the shape of the container body 636) with a central opening 770 extending between a first open end and a second perforated end (not labeled). The mixing element 728 is made from a suitable material, such as metal, and is of a suitable length and nominal diameter for mixing a multi-phase cosmetic composition in a desired container.

The second or bottom perforated end of the plunger body 768 includes a plurality of perforations 774 in fluid communication with the central opening 770 that are configured to cause mixing of the immiscible components of the multi-phase cosmetic composition as the plunger 766 is actuated; e.g., as it is moved substantially axially within the container body 636. The mixing element 728 is similar to the mixing element 628 described above in that each perforation 774 extends axially along a length of a bottom portion of the plunger body 768 and continues radially onto a bottom surface of the plunger body 768 to connect to the other perforations 774 at substantially the center of the bottom surface. However, as each perforation 774 continues radially onto a bottom surface of the plunger body 768, it also extends upwardly toward the first or upper end of the plunger body 768.

Figure 13:
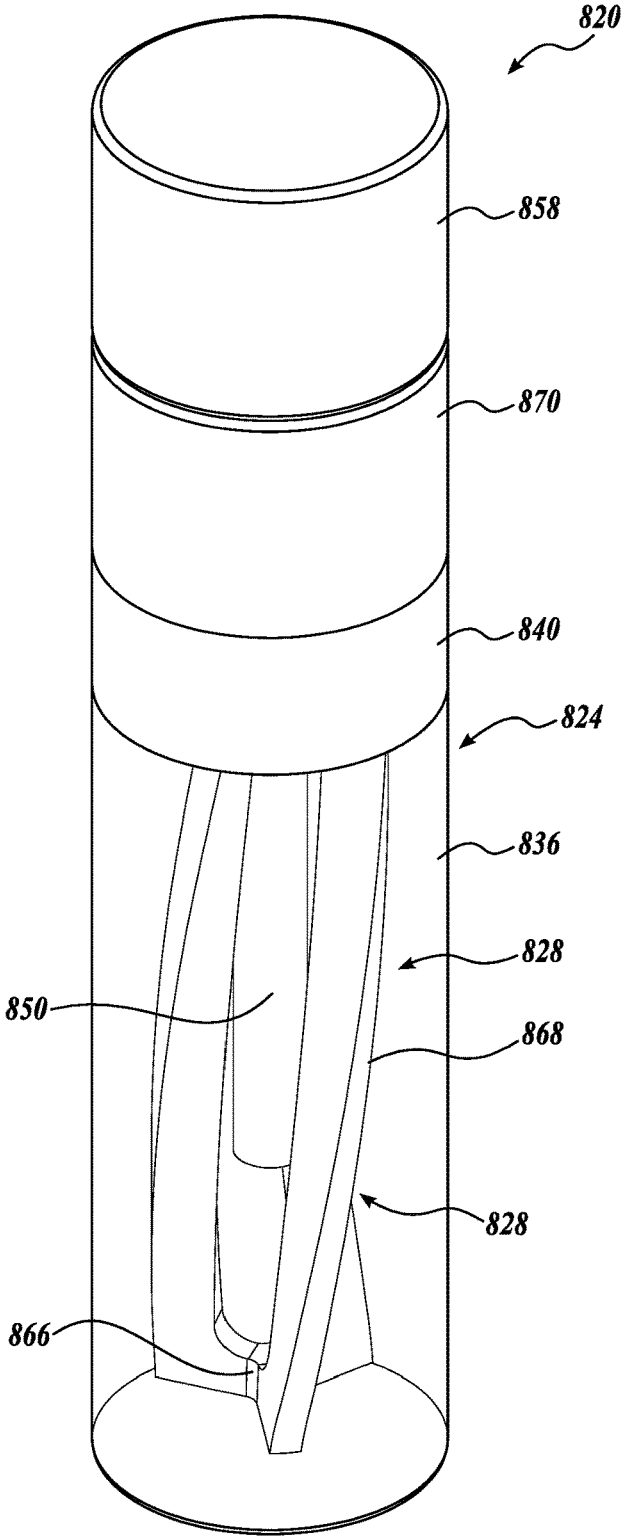
FIG. 13 is an isometric view of a mixing pack formed in accordance with a third exemplary embodiment of the present disclosure, wherein the mixing pack includes a mixing element.
Figure 14:
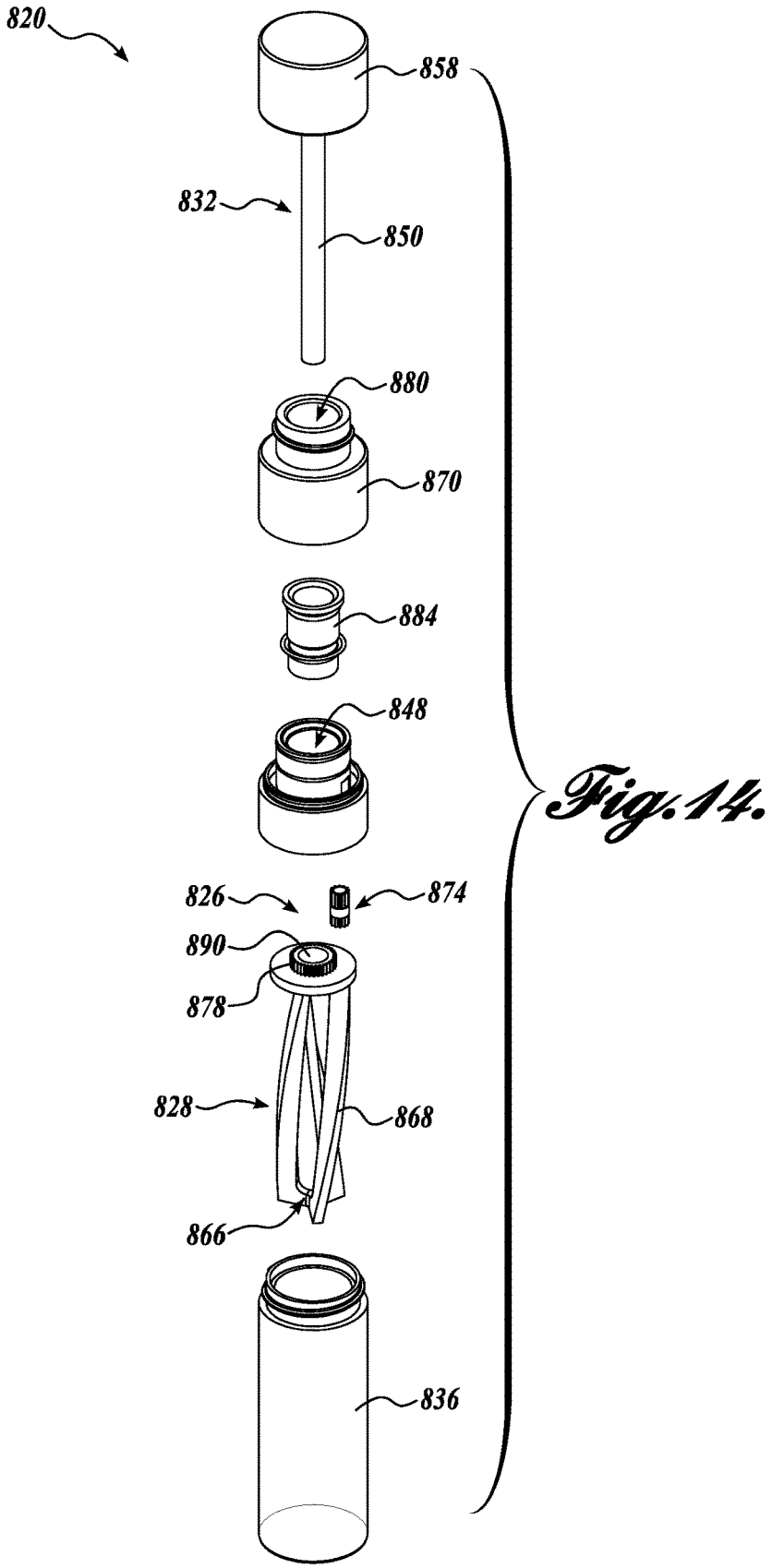
FIG. 14 is an exploded view of the mixing pack of FIG. 13.
Figure 15:
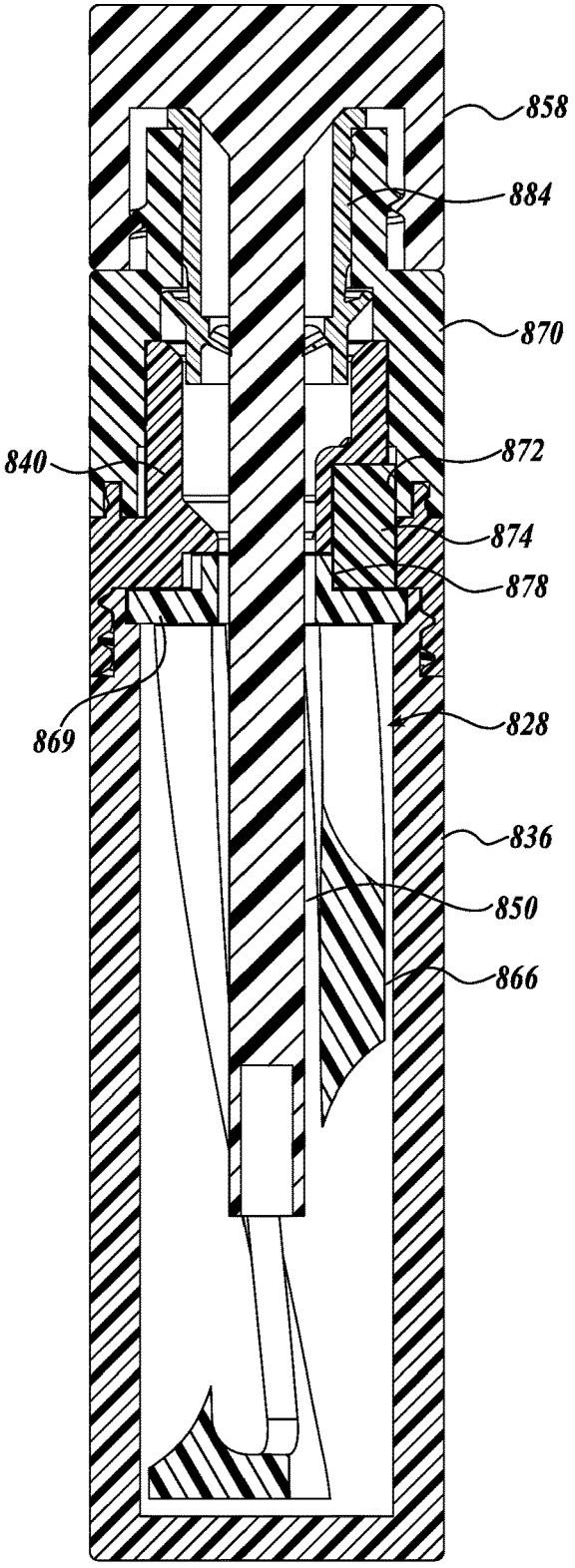
FIG. 15 is a cross-sectional view of the mixing pack of FIG. 13.

FIGS. 13-15 depict a third exemplary embodiment of a mixing pack 820 suitable for mixing a multi-phase cosmetic composition (not shown) so that the immiscible components are temporarily miscible. The mixing pack 820 generally includes a container 824 for holding a multi-phase cosmetic composition, a mixing element 828 for mixing the multi-phase cosmetic composition, an actuation assembly 826 for actuating the mixing element 828, and an applicator 832 for applying the temporarily miscible components of the multi-phase cosmetic composition to a keratinous material.

The container 824 will first be described in detail. The container 824 may be any suitable shape, size, configuration, material, etc., to appropriately hold a desired multi-phase cosmetic composition. In the depicted embodiment, the container 824 includes a substantially cylindrically-shaped glass or plastic container body 836 having a first (or top) open end that receives a container end cap 840 secured to the body 836 by threading, snap-fit, or otherwise. It should be appreciated that the container 824 may instead be comprised of a container body that is integrally formed with the container end cap 840.

The container end cap 840 encloses and seals the first, top open end of the container body 836 and provides an interface between the mixing element 828 and the actuation assembly 826. In that regard, an exemplary mixing element 828 and actuation assembly 826 will now be described.

In the embodiment depicted in FIGS. 13-15, the mixing element 828 is embodied as a mixing head 866 having a plurality of axially extending twisted mixing elements 868 extending from an actuation plate 869 along the length of the mixing element 828. In the depicted embodiment, the mixing head 866 includes three axially extending twisted mixing elements 868; however, any suitable number may instead be used. Each axially extending twisted mixing element 868 includes a shape, width, and thickness suitable to cause mixing of the immiscible components of the multi-phase cosmetic composition as the mixing head 866 is actuated; e.g., as it is rotated about its longitudinal axis within the container body 836. More specifically, the immiscible components flow into and out of the openings defined by the axially extending twisted mixing elements 868 as the mixing head 866 is actuated.

The mixing head 866 may include any suitable number and configuration of axially extending twisted mixing elements 868, such as size, shape, length, etc., for the intended application. For instance, a low viscosity multi-phase cosmetic composition may be sufficiently mixed with a larger number of axially extending twisted mixing elements 868, wherein a higher viscosity multi-phase cosmetic composition may require a smaller number of axially extending twisted mixing elements 868 to sufficiently mix the immiscible components.

It should also be appreciated that any other suitable pattern and configuration of mixing elements or any other mixing head may instead be used. For instance, in lieu of axially extending twisted mixing elements 868, a whisk configuration may be used. As yet another configuration, a central core may extend along the length of the container that includes a plurality of uniform or irregular protrusions extending radially therefrom. Thus, any suitable mixing head or mixing elements that can be actuated by the actuation assembly 826 may be used.

The container 824 is suitably sized and shaped to enclose the mixing head 866 (or the mixing head 866 is sized to fit within the container 824) such that when the mixing head 866 is actuated (i.e., rotated axially within the container body 836), the multi-phase cosmetic composition contained within the container 824 is appropriately mixed. In that regard, the mixing head 866 has a length that generally extends along the length of the container body 836 and has a nominal diameter that is sufficiently large such that it reaches substantially all the contents within the container 824 when actuated.

The actuation assembly 826 is configured to rotate the mixing head 866 about the longitudinal axis of the container 824. In the depicted embodiment, the actuation assembly 826 is defined by a planetary gear assembly configured to transfer rotation of an actuator end cap 870 to the mixing head 866, wherein the actuator end cap 870 is rotatably secured to the container end cap 840 by snap fit or another suitable method. In that regard, the planetary gear assembly may include a first ring gear 872 (shown only in cross section in FIG. 15) disposed within the interior of the actuator end cap 870. A third sun gear 878 may be secured to an upper surface of the actuation plate 869, and a second planet gear 874 may be disposed between the first ring gear 872 and the third sun gear 878 for transferring rotation of the first ring gear 872 to the third sun gear 878. As such, when the actuator end cap 870 is rotated about the longitudinal axis of the container 824 in a first direction, the third sun gear 878 (and therefore the mixing head 866) is also rotated about the longitudinal axis of the container 824.

The actuator end cap 870 includes a central opening 880 that provides an interface between the applicator 832 and the interior of the container body 836. More specifically, the central opening 880 is configured to removably receive the stem 850 and any tip (not shown) of the applicator 832. An internal sealing element or wiping assembly 884 may be disposed within the central opening 880 and have its own central opening 888 for allowing the stem 850 to pass therethrough. The stem 650 may pass through the central openings 880 and 888 of the actuator end cap 870 and wiping assembly 884 to position the distal end of the stem 850 within the interior of the container body 836 for withdrawing the multi-phase cosmetic composition for application to a keratinous material. The stem 850 is also configured to pass through a central opening 890 defined in the third sun gear 878 and actuation plate 869 such that the stem 850 may be positioned within the interior of the mixing head 866.

The stem 850 of the applicator 832 extends from an interior portion of a applicator cap 858 that is removably securable to the actuator end cap 870 (which is removably secured to the first container end cap 840 of the container body 836) for sealing and enclosing the cosmetic composition therein. The applicator cap 858 is removably secured to the actuator end cap 870 by threading, snap-fit, press-fit, or otherwise.

To use the mixing pack 820, the actuator end cap 870 is rotated about the longitudinal axis of the container 824 to activate the actuation assembly 826 or the gear assembly and thereby rotate the mixing head 866 about the longitudinal axis of the container 824. The mixing head 866 is actuated until the multi-phase cosmetic composition contained within the container 824 is appropriately mixed so that the immiscible components are temporarily miscible. Once the composition is mixed, the applicator cap 858 may be detached from the actuator end cap 870. With the applicator cap 858 detached, the applicator 832 can be withdrawn from the container 824 for application of the temporarily miscible components of the multi-phase cosmetic composition to a keratinous material.

It should be appreciated that any other suitable container body, caps, and applicator may be used for the desired application. For instance, the container may be configured to suit the intended use, for example, lip gloss, foundation, concealer, lacquer, etc.

Figure 16:
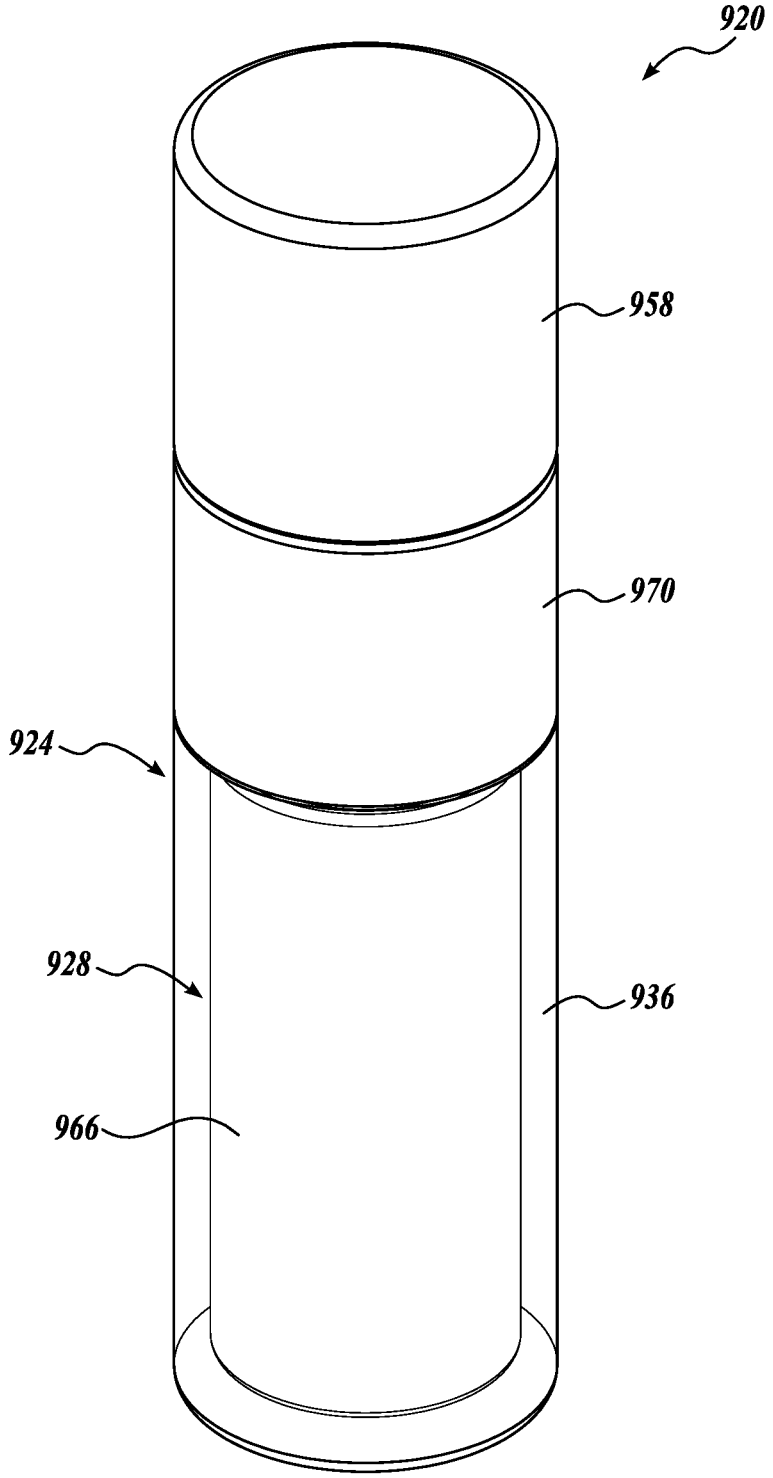
FIG. 16 is an isometric view of a mixing pack formed in accordance with a fourth exemplary embodiment of the present disclosure, wherein the mixing pack includes a mixing element.
Figure 17:
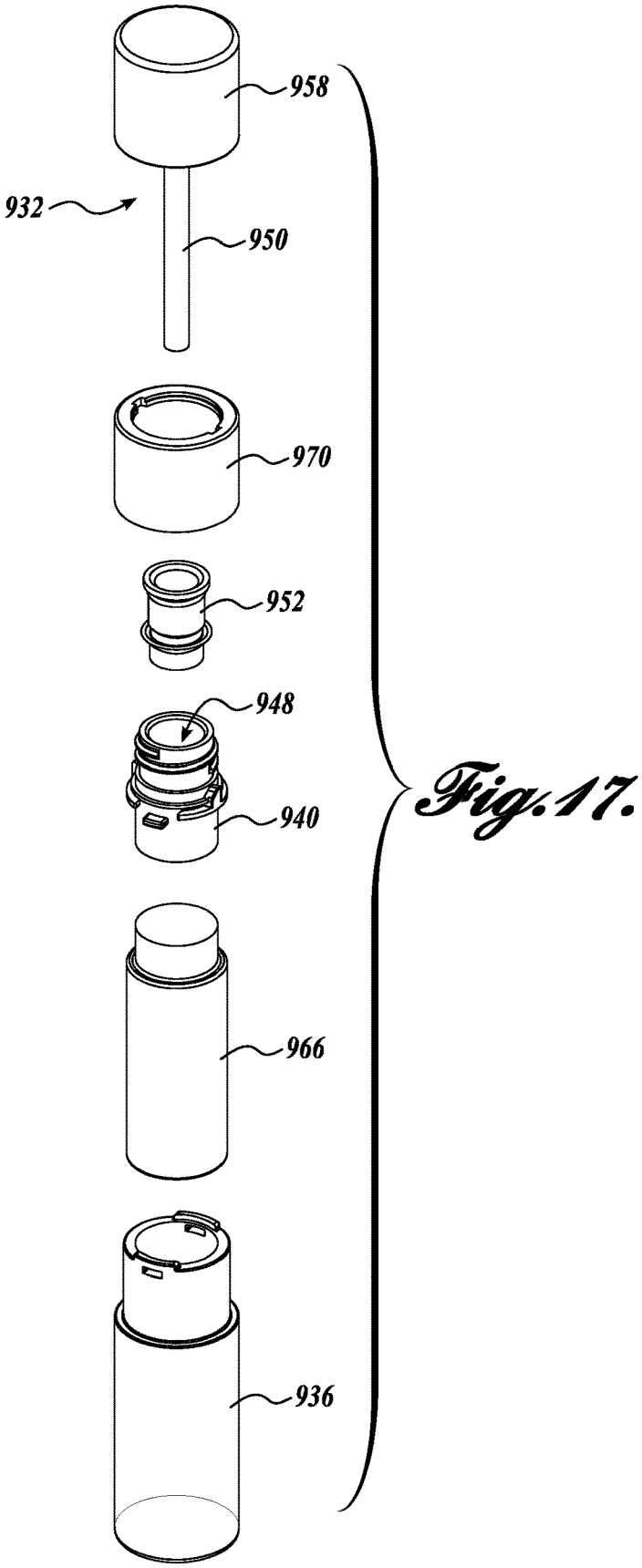
FIG. 17 is an exploded view of the mixing pack of FIG. 16.
Figure 18:
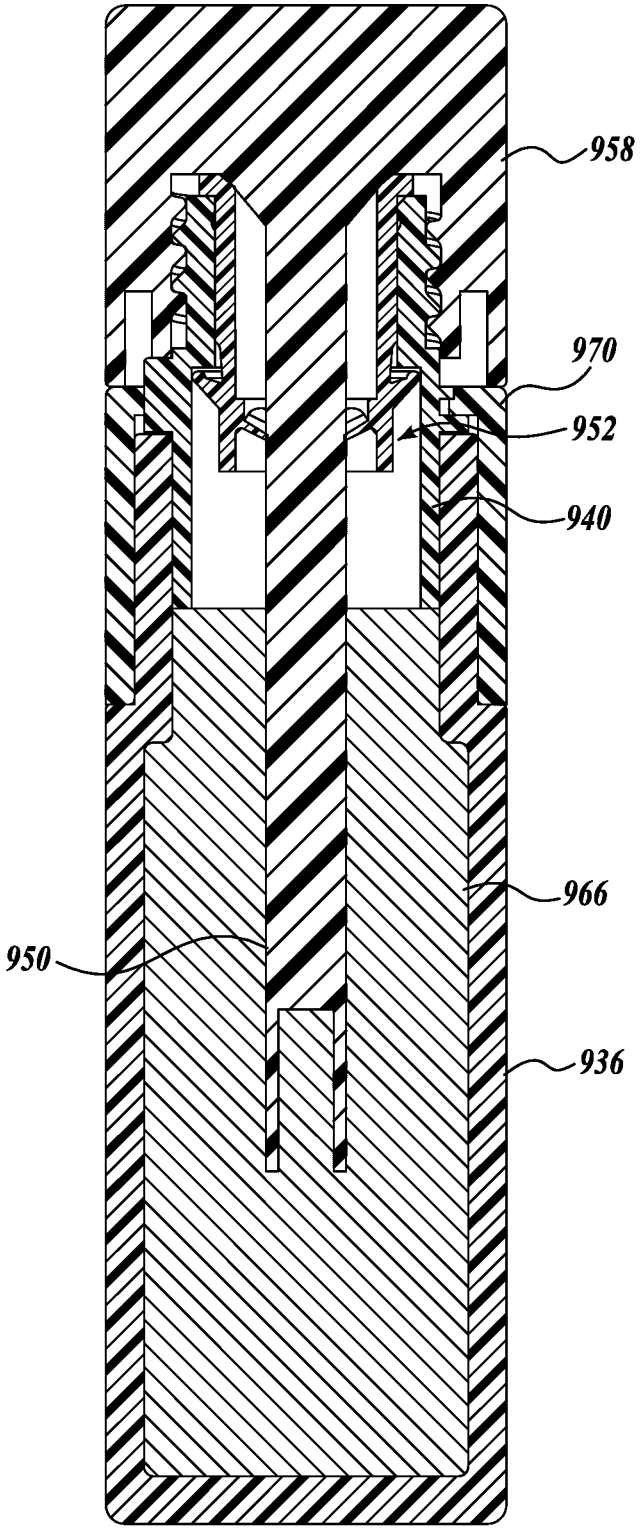
FIG. 18 is a cross-sectional view of the mixing pack of FIG. 16.

FIGS. 16-18 depict a fourth exemplary embodiment of a mixing pack 920 suitable for mixing a multi-phase cosmetic composition (not shown) so that the immiscible components are temporarily miscible. The mixing pack 920 generally includes a container 924 for holding a multi-phase cosmetic composition, a mixing element 928 for mixing the multi-phase cosmetic composition, and an applicator 932 for applying the temporarily miscible components of the multi-phase cosmetic composition to a keratinous material.

The container 924 will first be described in detail. The container 924 may be any suitable shape, size, configuration, material, etc., to appropriately hold a desired multi-phase cosmetic composition. In the depicted embodiment, the container 924 includes a substantially cylindrically-shaped deformable container body 936 made from a suitable material, such as silicone rubber, neoprene, etc. The container body 936 has a first (or top) open end that receives a container end cap 940 secured to the body 936 by threading, snap-fit, or otherwise. It should be appreciated that the container 924 may instead be comprised of a container body that is integrally formed with the container end cap 940.

The container end cap 940 encloses and seals the first, top open end of the container body 936 and provides an interface between the applicator 932 and the interior of the container 924. In that regard, the container end cap 940 includes a central opening 948 extending from a top surface to a bottom surface of the end cap 940. The central opening 948 is sized to allow the applicator 932 to pass therethrough, which in the depicted embodiment includes a stem 950. The stem 950 may pass through the central opening 948 and extend into the container body 936 to position a tip (not shown) within the interior of the container body 936 for withdrawing the multi-phase cosmetic composition for application to a keratinous material. The container end cap 940 may include an internal wiping assembly 952 that helps wipe excess cosmetic composition from the applicator tip as it is removed from the container body 936. Any suitable internal wiping assembly for the intended application may be used.

The stem 950 of the applicator 932 extends from an interior portion of an applicator cap 958 that is removably securable to the first, top open end of the container end cap 940 for sealing and enclosing the cosmetic composition therein. The applicator cap 958 may be removably secured to the top end of the container end cap 940 in any suitable manner, such as by threading, a snap-fit, friction fit, or otherwise. An optional collar 970 may be secured on the first open end of the container body 936 and disposed between the container body 936 and the applicator cap 958 to help secure the container end cap 940 within the first, top open end of the container body 936.

In the embodiment depicted in FIGS. 16-18, the mixing element 928 is embodied as an inner bag or bladder 966 that is deformable for containing and mixing the immiscible components of the multi-phase cosmetic composition. More specifically, the immiscible components are contained within the inner bladder 966 and are mixed as the deformable container body 936 is squeezed or otherwise deformed, thereby deforming and squeezing the inner bladder 966. The inner bladder 966 may be made from a suitable deformable material for containing the multi-phase cosmetic composition without causing adverse reactions, such as foil or plastic.

The inner bladder 966 is actuated until the multi-phase cosmetic composition contained therein is appropriately mixed so that the immiscible components are temporarily miscible. Once the composition is mixed, the container cap 958 may be detached from the container body 936. With the container cap 958 detached, the applicator 932 can be withdrawn from the inner bladder 966 for application of the temporarily miscible components of the multi-phase cosmetic composition to a keratinous material.

It should be appreciated that any other suitable container body, caps, and applicator may be used for the desired application. For instance, the container may be configured to suit the intended use, for example, lip gloss, foundation, concealer, lacquer, etc.

It should also be appreciated that certain features of each embodiment may be eliminated or replaced with other features shown in described in other embodiments. For instance, in some embodiments, the stem and applicator tip may be removed. Such an embodiment may be suitable for applications such as foundation, lotion, etc., where application is done with a user's finger tips, a cotton swab, etc. Thus, the claimed subject matter is not limited to the mixing assemblies, actuator assemblies, applicators, or the precise mixing pack embodiments disclosed herein.

The mixing packs described above may also be comprised of certain materials, surface treatments, surface features, coatings, etc., to improve the interaction of the mixing pack with the multi-phase cosmetic composition. For instance, at least a portion of the mixing elements may be treated with a suitable material that increases wetting of an aqueous phase of the multi-phase cosmetic composition on the surface of the mixing element. In one embodiment, one or more surfaces of the mixing element may be comprised of at least one hydrophilic or a superhydrophilic surface. The mixing element may also be treated to increase wetting of a silicone phase of the multi-phase cosmetic composition on the surface of the mixing element. For instance, in an embodiment, one or more surfaces of the mixing elements may be comprised of at least one hydrophobic or superhydrophobic surface.

The wettability of a region can be determined using various technologies and methodologies including contact angle methods, the Goniometer method, the Whilemy method, or the Sessile drop technique. Wetting is a process by which a liquid interacts with a solid. Wettability (the degree of wetting) is determined by a force balance between adhesive and cohesive force and is often characterized by a contact angle. The contact angle is the angle made by the intersection of the liquid/solid interface and the liquid/air interface. Alternatively, it is the angle between a solid sample's surface and the tangent of a droplet's ovate shape at the edge of the droplet. Contact angle measurements provide a measure of interfacial energies and conveys direct information regarding how hydrophilic or hydrophobic a surface is. For example, superhydrophilic surfaces have contact angles less than about 5°, hydrophilic surfaces have contact angles less than about 90°, hydrophobic surfaces have contact angles greater than about 90°, and superhydrophobic surfaces have contact angles greater than about 150°. (see, e.g. U.S. Publication No° 2013/0131575, entitled "Systems, Devices, and Methods Including Infection-Fighting and Monitoring Shunts," the disclosure of which is hereby incorporated by reference herein in its entirety).

As a specific example, the mixing elements may be treated with one or more hydrophilic coatings, including polyvinylpyrolidone (PVP), polyurethanes, polyacrylic acid (PAA), polyethylene oxide (PEO), and/or polysaccharides. In the alternative or in addition thereto, the mixing elements may be treated to increase the surface energy of the mixing element, such as with a plasma treatment.

In another example, the mixing element may be treated with one or more hydrophobic or superhydrophobic coatings such as manganese oxide polystyrene (MnO2/PS) nano-composite, zinc oxide polystyrene (ZnO/PS) nano-composite, precipitated calcium carbonate[3], carbon nano-tube structures, and/or silica nano-coating.

Additional non-limiting examples of materials that affect wettability of a surface include, but are not limited to, amphoteric surfactants, anionic surfactants, cationic surfactants, non-ionic surfactants, and the like.

In the alternative or in addition thereto, the mixing elements may comprise one or more nanostructures, microstructures, hierarchical structures, and the like that affect wettability of a surface. Non-limiting examples of nanostructures, microstructures, hierarchical structures, and the like include nanopatterned, micropatterned, and the like polymeric coatings. Specific examples include patterned silicon surface, perfluorodecyltriethyoxysilane (PFDTES) coatings, poly (methyl methacrylate) (PMMA) patterned structures, polystyrene (PS) (hydrophobic) patterned structures, and the like.

The above-noted treatments may be applied to any suitable portion of the mixing element. For instance, if a mixing element includes more than one surface, the first surface may be treated with a hydrophilic coating or similar, and the second surface may be treated with a hydrophobic coating or similar. In another alternative configuration, the mixing element may be formed from a hydrophilic material or similar, and a hydrophobic material or coating may be overmolded or treated on one surface of the mixing element. In such configurations, the mixing element would have at least two different surface properties.

It should also be appreciated that the surface properties of the mixing element may be defined in any suitable manner. For instance, the mixing element itself may be made from a hydrophilic material or hydrophobic material. In the alternative, the mixing element may be made from any suitable material, and one or more surfaces of the mixing element may be treated with a hydrophilic material or hydrophobic material. Moreover, the mixing element may be treated, coated, sprayed, etc., with a suitable material in any suitable manner. In addition, the mixing element may be textured or patterned in a suitable manner.

The detailed description set forth above in connection with the appended drawings is intended as a description of exemplary embodiments of mixing packs having mixing elements for use with containers containing a multi-phase cosmetic composition, and are not intended to represent the only embodiments. The representative embodiments described in this disclosure are provided merely as an example or illustration and are not intended to be exhaustive or to limit the claimed subject matter to the precise forms disclosed.

In the foregoing description, numerous specific details are set forth in order to provide a thorough understanding of the exemplary embodiments of the present disclosure. It will be apparent to one skilled in the art, however, that the exemplary embodiments of the present disclosure may be practiced without some or all of the specific details. In some instances, well-known process steps or features have not been described in detail in order not to unnecessarily obscure various aspects of the present disclosure. Further, it will be appreciated that the exemplary embodiments of the present disclosure may employ any combination of features described herein.

The present disclosure may also include references to directions, such as "forward," "rearward," "front," "back," "upward," "downward," "lateral," "medial," "in," "out," "extended," "advanced," "retracted," "vertical," "horizontal," "proximal," "distal," "central," etc. These references, and other similar references in the present disclosure, are only to assist in helping describe and understand the particular embodiment and are not intended to limit the present disclosure to these directions or locations.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. In an embodiment, "about," "approximately," etc., means plus or minus 5% of the stated value.

Thus, while illustrative embodiments have been illustrated and described, it will be appreciated that various changes can be made therein without departing from the spirit and scope of the invention.

The embodiments of the invention in which an exclusive property or privilege is claimed are defined as follows:

1. A multi-phase cosmetic composition mixing pack for mixing immiscible components of a multi-phase cosmetic composition such that they are temporarily miscible, the mixing pack comprising:

a container for holding the multi-phase cosmetic composition, the container having a first open end and a container longitudinal axis; and a mixing element disposed within the container and configured to be actuated for mixing immiscible components of the multi-phase cosmetic composition such that they are temporarily miscible, wherein the mixing element is limited to movement substantially along the container longitudinal axis when actuated, wherein the mixing element is a shake weight comprising:

a substantially cylindrical body having a hollow interior extending between first and second ends, the first end defined by a continuous upper perimeter of the body and the second end defined by a continuous lower perimeter of the body; and a plurality of openings defined in the substantially cylindrical body that allow for the flow of the multi-phase cosmetic composition into and out of the hollow interior.

2. The mixing pack of claim 1, wherein the shake weight is a coil spring.

3. The mixing pack of claim 1, wherein the shake weight is a heavy-duty coil spring designed for compression and tension.

4. The mixing pack of claim 1, wherein the weight of the shake weight and a thickness of the multi-phase cosmetic composition is a predetermined ratio.

5. The mixing pack of claim 1, wherein the plurality of openings extend from an exterior surface of the body to an interior surface of the body, and wherein the body has a thickness.

6. The mixing pack of claim 5, wherein the each of the plurality of openings taper in size as they extend from the exterior surface of the body to the interior surface of the body.

7. The mixing pack of claim 6, wherein a plurality of legs extend axially away from the first and second ends of the body.

8. The mixing pack of claim 6, wherein at least some of the plurality of openings extend radially toward a central axis of the body.

9. The mixing pack of claim 8, wherein at least some of the plurality of openings extend diametrically across the body.

10. The mixing pack of claim 5, wherein a plurality of legs extend axially away from the first and second ends of the body.

11. The mixing pack of claim 1, wherein the plurality of openings are generally helically patterned.

12. The mixing pack of claim 11, wherein a plurality of legs extend axially away from the first and second ends of the body.

13. The mixing pack of claim 1, further comprising an applicator for applying the temporarily miscible components of the multi-phase cosmetic composition to a keratinous material, the applicator comprising an applicator portion on a distal end of a stem.

14. The mixing pack of claim 1, wherein the mixing element is comprised of at least one of a hydrophilic material and a hydrophobic material.

15. The mixing pack of claim 14, wherein the hydrophilic material is chosen from a group consisting of polyvinylpyrolidone (PVP), polyurethanes, polyacrylic acid (PAA), polyethylene oxide (PEO), polysaccharides, and any combination thereof.

16. The mixing pack of claim 14, wherein the hydrophobic material is chosen from a group consisting of manganese oxide polystyrene (MnO2/PS) nano-composite, zinc oxide polystyrene (ZnO/PS) nano-composite, precipitated calcium carbonate[3], carbon nano-tube structures, silica nano-coating, and any combination thereof.

17. The mixing pack of claim 14, wherein the mixing element is treated with a plasma treatment.

18. The mixing pack of claim 14, wherein the mixing element has a patterned surface to increase wettability.

19. The mixing pack of claim 1, wherein a plurality of legs extend axially away from the first and second ends of the body.

* * * * *